US005775162A

United States Patent [19]

Ward

[11] Patent Number: 5,775,162

[45] Date of Patent: Jul. 7, 1998

[54] METHOD AND APPARATUS FOR FORMING SHEET METAL DUCTS

[76] Inventor: Raymond L. Ward, 58 Howarth Rd., Oxford, Mass. 01540

[21] Appl. No.: 865,990

[22] Filed: May 30, 1997

[51] Int. Cl.[6] ..... B21D 5/02

[52] U.S. Cl. ..... 72/389.3; 72/319

[58] Field of Search ..... 72/389.1, 389.3, 72/389.4, 319, 101, 105, 134

[56] References Cited

U.S. PATENT DOCUMENTS

| | | | |
|---|---|---|---|
| 3,214,955 | 11/1965 | Voth | 72/389.4 |
| 3,218,839 | 11/1965 | Rosanes | 72/389.3 |
| 3,996,778 | 12/1976 | Sparks | 72/134 |
| 4,391,119 | 7/1983 | Schmitz | 72/389.3 |
| 4,926,671 | 5/1990 | Hill | 72/389.3 |
| 5,303,572 | 4/1994 | Knudson | 72/389.3 |

FOREIGN PATENT DOCUMENTS

| | | | |
|---|---|---|---|
| 1265163 | 5/1961 | France | 72/389.3 |

*Primary Examiner*—David Jones
*Attorney, Agent, or Firm*—John E. Toupal; Harold G. Jarcho

[57] ABSTRACT

A closed tube forming apparatus including a base having spaced apart first and second support members; an elongated first die having one end supported by the first support member and an opposite end supported by the second support member, the one end being detachable from the first support member so as to permit separating movement therebetween; and an elongated second die supported by the base and extending parallel to the first die. One of the first and second dies has a transverse V-shaped cross section forming a knife edge and the other die defines a longitudinally extending V-shaped groove conforming substantially to the V-shaped cross section. Also included in the apparatus are a drive mechanism for producing relative movement between the first and second dies into forming positions with the knife edge received by the groove and a release mechanism operable to effect the detachment of the one end from the first support member and thereby permit the separating movement therebetween into positions substantially spaced apart.

20 Claims, 5 Drawing Sheets

METHOD AND APPARATUS FOR FORMING SHEET METAL DUCTS

BACKGROUND OF THE INVENTION

This invention relates generally to a method and apparatus for producing ductwork and, more particularly, to a method and apparatus for producing duct sections used in heating and ventilation systems.

Heating and ventilation ducts are commonly formed in sections of predetermined length which are then connected to form a continuous air distribution duct. The duct sections are usually formed of sheet metal of desired gauge fed from a roll or coil of material. As the sheet metal uncoils, it is flattened or straightened and then notched along its side edges at predetermined distances where the corners of the duct section are to be formed. A shear then cuts the material into blanks of a length necessary to form a finished duct section. This notched blank is then moved 90 degrees onto a roll former to create male and female portions of a Pittsburgh seam at opposite ends of the blank. Next, the blank is transferred to a sheet metal break where three 90 degree bends are made to form the box-shaped section. Obviously, this process is time consuming and requires a considerable amount of floor space for the equipment, conveyors and transfer tables utilized.

The object of this invention, therefore, is to provide an improved, more efficient method and apparatus for producing heating and ventilation duct sections.

SUMMARY OF THE INVENTION

The invention is a duct forming apparatus including a base having spaced apart first and second support members; an elongated first die having one end supported by the first support member and an opposite end supported by the second support member, the one end being detachable from the first support member so as to permit separating movement therebetween; and an elongated second die supported by the base and extending parallel to the first die.

One of the first and second dies has a transverse V-shaped cross section forming a knife edge and the other die defines a longitudinally extending V-shaped groove conforming substantially to the V-shaped cross section. Also included in the apparatus are a drive mechanism for producing relative movement between the first and second dies into forming positions with the knife edge received by the groove and a release mechanism operable to effect the detachment of the one end from the first support member and thereby permit the separating movement therebetween into positions substantially spaced apart. Separation of the one end of the first die from the first support member permits removal of a finished duct section from the first die.

According to one feature of the invention, the one end of the first die is mounted for separating movement away from the first support member after detachment therefrom by the release mechanism. Providing for movement of the first die simplifies the desired separation of die and support.

According to another feature of the invention, the relative movement between the first and second dies is in a plane defined thereby, and the separating movement is transverse to the plane. This feature provides the desired separation movement in an efficient manner.

According to still another feature of the invention, the opposite end of the first die is pivotally supported by the second support member, and the first die is above the second die. This feature facilitates removal of a completed duct section.

According to a further feature of the invention, the drive mechanism includes a piston for producing vertical upward movement of the second die relative to the first die, the base includes a cabinet enclosing the drive mechanism and projecting in a horizontal direction from the second die, and the first die is mounted on the second support member for pivotal movement in the horizontal direction. Providing first die movement a cabinet projection in the same direction optimizes use of floor space.

According to additional features, the invention includes a table attached to the second die and covering the housing, and a skirt secured to the table and extending downwardly therefrom, the table and skirt being shaped and arranged to prevent exposure of the drive mechanism during upward movement of the second die. These features protect an operator from injury by the drive mechanism.

According to a further feature of the invention, the second die defines an elongated notch formed longitudinally in the groove. The notch is arranged to receive an outer edge of a Pittsburgh type joint of a duct being formed by the first and second dies.

The invention also encompasses a method of forming a duct including the steps of providing an elongated first die having one end supported by a first support member and an opposite end supported by a second support member; providing an elongated second die movable toward the first die and arranged to produce a substantially 90° bend in a piece of sheet metal material; sequentially feeding a piece of sheet metal into different positions between the first and second dies; and activating the second die in each position to produce a 90° bend in the piece, the bends being parallel and forming the piece into an open ended box enclosing the first die. After formation of the box, the one end of the first die is isolated from the first support member; and the box is removed from the first die by withdrawal thereof over the isolated one end thereof.

According to one feature of the method, the isolating step entails detaching and separating the one end of the first die from the first support member. The detachment and separating steps provide the desired isolation of the one end of the first die.

According to another feature of the method the separating step entails pivoting the first die on the second support member. The desired isolation is simplified by the pivoting step.

According to still another feature, the method includes the step of engaging edge portions of a Pittsburgh type seam previously formed in the piece. This step establishes the removed box as a finished duct section.

According to one embodiment, the method includes the step of creating an initial 90° bend in the piece fed between the first and second dies, and the feeding step entails sequentially feeding the piece into two different positions. In this embodiment, the method utilizes a piece of sheet metal having a preformed 90° bend.

According to another embodiment, the feeding step entails sequentially feeding the piece into three different positions. According to this embodiment, the method creates three bends required to close the box.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
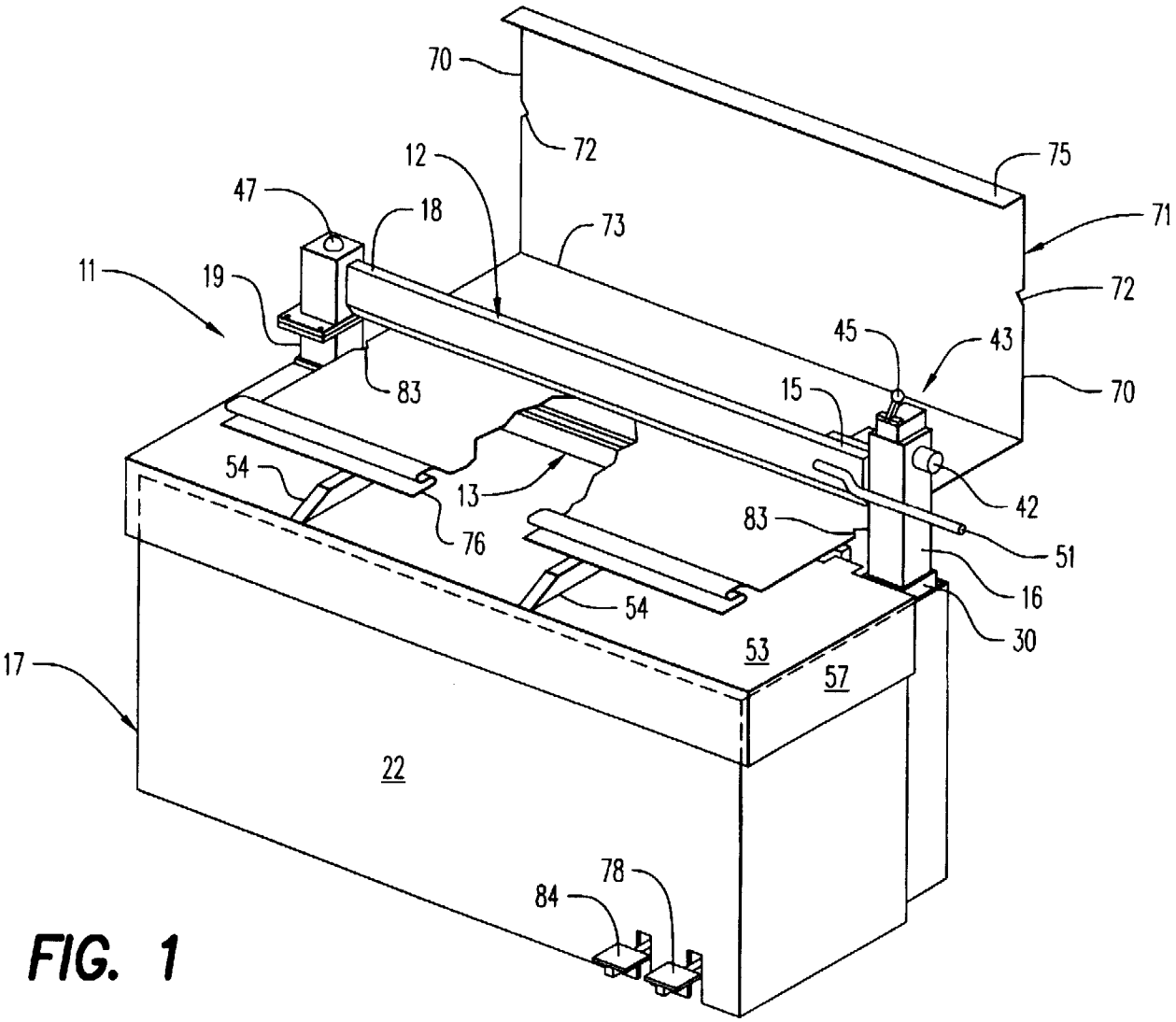
FIG. 1 is a perspective view of a duct forming machine according to the invention.

A duct forming machine 11 includes a first elongated die 12 and a second elongated die 13 parallel thereto. Supporting one end 15 of the first die 12 is a first support member 16 of a base 17 while an opposite end 18 of the die 12 is supported by a second support member 19 of the base 17. The second die 13 also is supported by the base 17 and is movable in a vertical plane defined by the parallel dies 12 and 13 as described hereinafter. Opposite ends of the second die 13 are fixed to rectangular collars 30 that slide on the first and second supports 16, 19.

Figure 3:
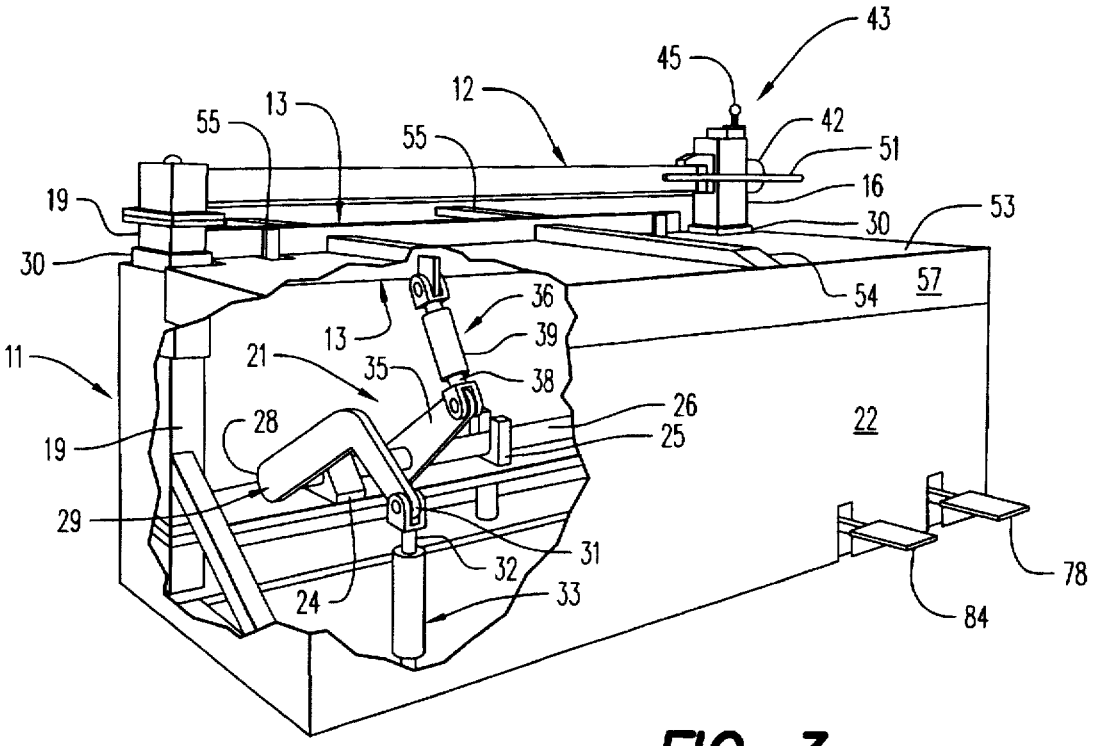
FIG. 3 is a perspective cut-away view of the machine shown in FIGS. 1 and 2.

A drive mechanism 21 (FIG. 3) for the second die 13 is retained within a cabinet portion 22 of the base 17. Rotatably mounted in support members 24, 25 is a rotatable shaft 26. One end 28 of a crank arm 29 is fixed to an end of the shaft 26 while the other end 31 of the arm 29 is pivotally attached to a piston 32 of an air cylinder assembly 33. Coupling the shaft 26 to the second die 13 is a drive arm 35 and an adjustment mechanism 36. The drive arm 35 has one end fixed to the shaft 26 and an opposite end pivotally attached to an externally threaded pin 38 of the adjustment mechanism 36. Engaged with the pin 38 is an internally threaded cylinder 39 having an end pivotally attached to the second die 13. A drive mechanism (not shown) similar to the drive mechanism 21 is coupled to the second die 13 within a right hand portion of the cabinet 22.

Figure 4A:
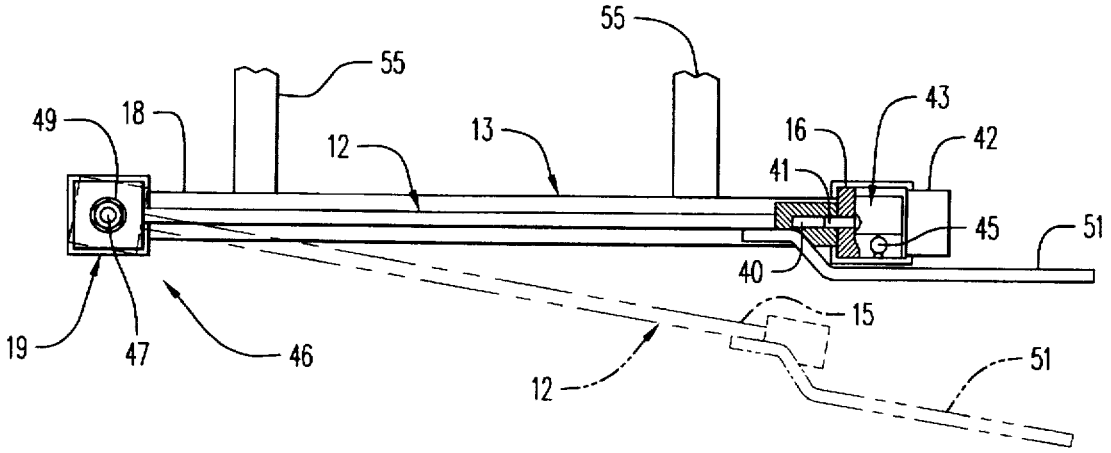
FIG. 4*a* is a top view illustrating in partial section details of the movable die.
Figure 4B:
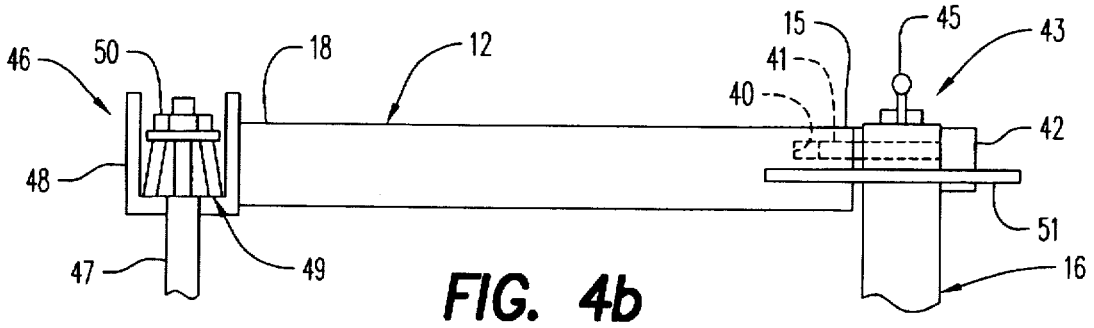
FIG. 4*b* is a front view illustrating in partial section the movable die.

As illustrated in FIGS. 4*a* and 4*b*, the end 15 of the first die 12 is detachably attached on the first support member 16 by a reciprocable pin 41. An outer end of the pin 41 is received by a cylindrical opening 40 in the first end 15 of the die 12 and an inner end of the pin 41 is supported by the support member 16 and operatively coupled to an air cylinder 42 of a release mechanism 43. In response to manipulation of an operating lever 45, the air cylinder 42 withdraws the pin 41 from the opening 40 thereby detaching the end 15 of the first die 12 from the first support member 16. The opposite end 18 of the first die 12 is pivotally attached to the second support member 19 by a pivot assembly 46. Included in the pivot assembly 46 is a Temkin bearing assembly 49 pivotally coupling a cylindrical collar 48 to a post 47 of the base 17. The collar 48 is attached to the end 18 of the first die 12 and a nut is turned on the threaded post 47 to tightly secure the bearing assembly between the post and the collar 48. After withdrawal of the pin 41 from the opening 40 by the release mechanism 43, a machine operator can employ a handle 51 to pivot the die 12 on the support member 19 as depicted by dashed lines in FIG. 4*a*. The pivotal movement of the die 12 is transverse to a vertical plane through the second die 13 and in a horizontal direction in which the cabinet 22 projects therefrom.

Attached to for movement with the second die 13 is a table 53 that covers the cabinet 22. Mounted on the table 53 and extending transversely from the second die 13 are a pair of spaced apart support bars 54. Also fixed for movement with the table 53 and projecting transversely from the opposite side of the second die 13 are a pair of cantilevered support bars 55. A downwardly projecting skirt portion 57 of the table 53 encloses an upper marginal portion of the cabinet 22 so as to prevent exposure of the drive mechanism 21 during upward movement of the table 53.

Figure 5A:
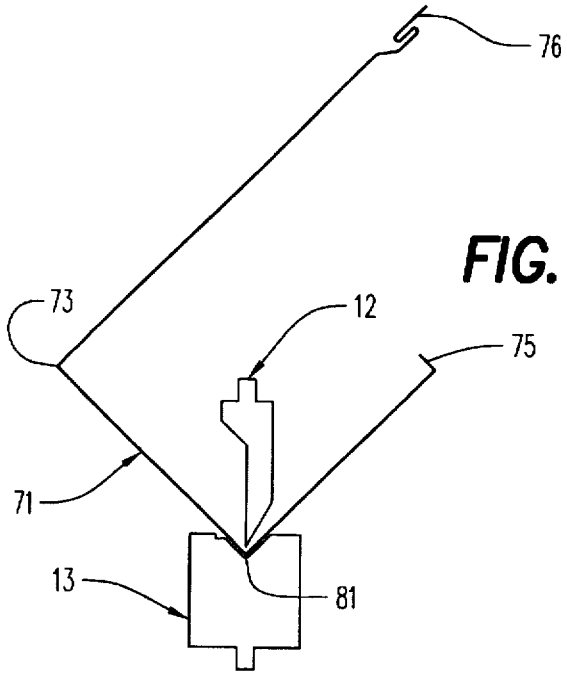
FIGS. 5*a*–5*e* are schematic diagrams depicting sequential operating steps during formation of a duct.
Figure 5B:
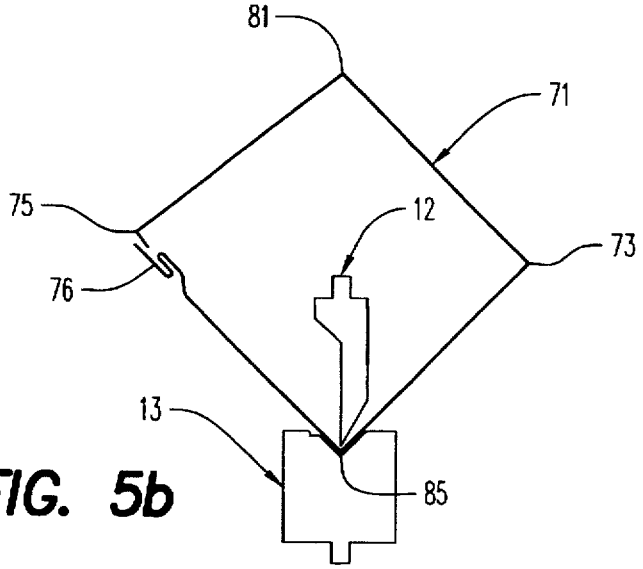
Figure 5C:
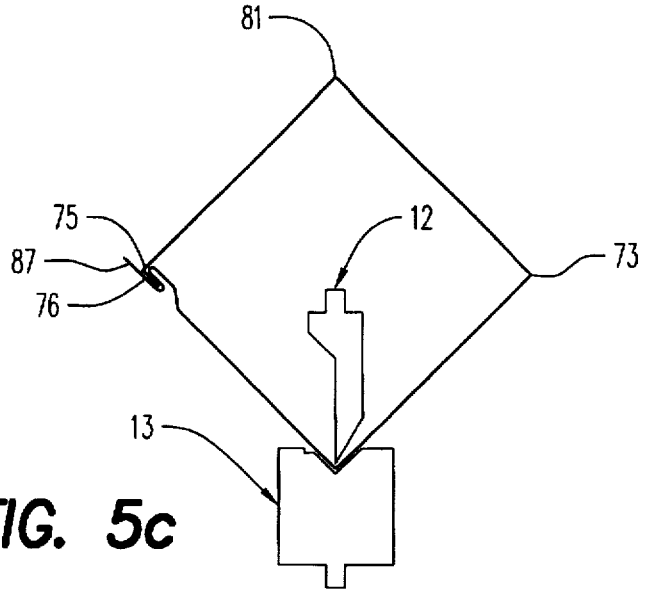
Figure 5D:
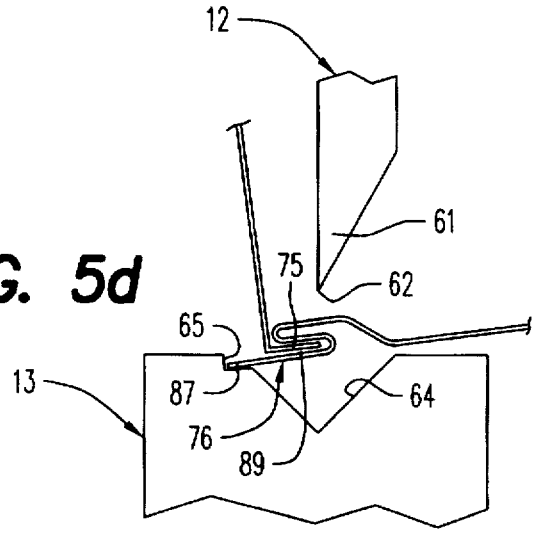
Figure 5E:
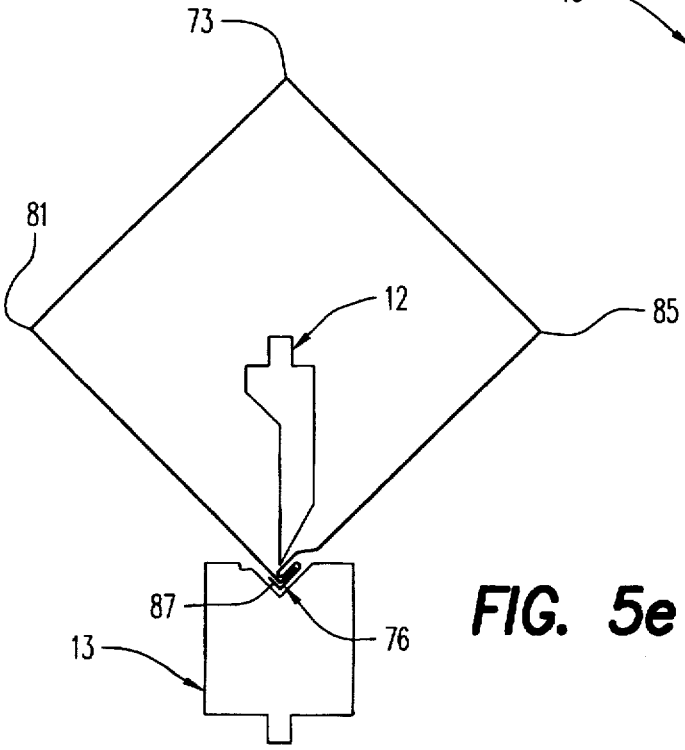

The first die 12 has a V-shaped transverse sectional portion 61 that forms a knife edge 62 as shown in FIG. 5*d*. Conforming to the portion 61 of the first die 12 is an elongated longitudinally extending V-shaped groove 64 in the second die 13. One surface of the groove 64 defines an elongated notch 65 that extends through the entire length of the second die 13 and functions as described hereinafter.

OPERATION

During use of the machine 11, a piece 71 of sheet metal is manually fed by a machine operator into a first position on the support bars 54, 55. The first position of the piece 71 is established by aligning notches 72 on opposite side edges 70 of the piece 71 with the second die 13. Preferably, the sheet metal piece 71 is obtained from a conventional coil line machine (not shown) which forms in the piece 71 an initial 90° bend 73 perpendicular to the side edges 70. Also formed by the coil line machine along a rear edge 75 of the piece 71 is a tab portion of a Pittsburgh type seam and along a front edge 76 thereof a pocket portion of the Pittsburgh type seam.

Figure 2:
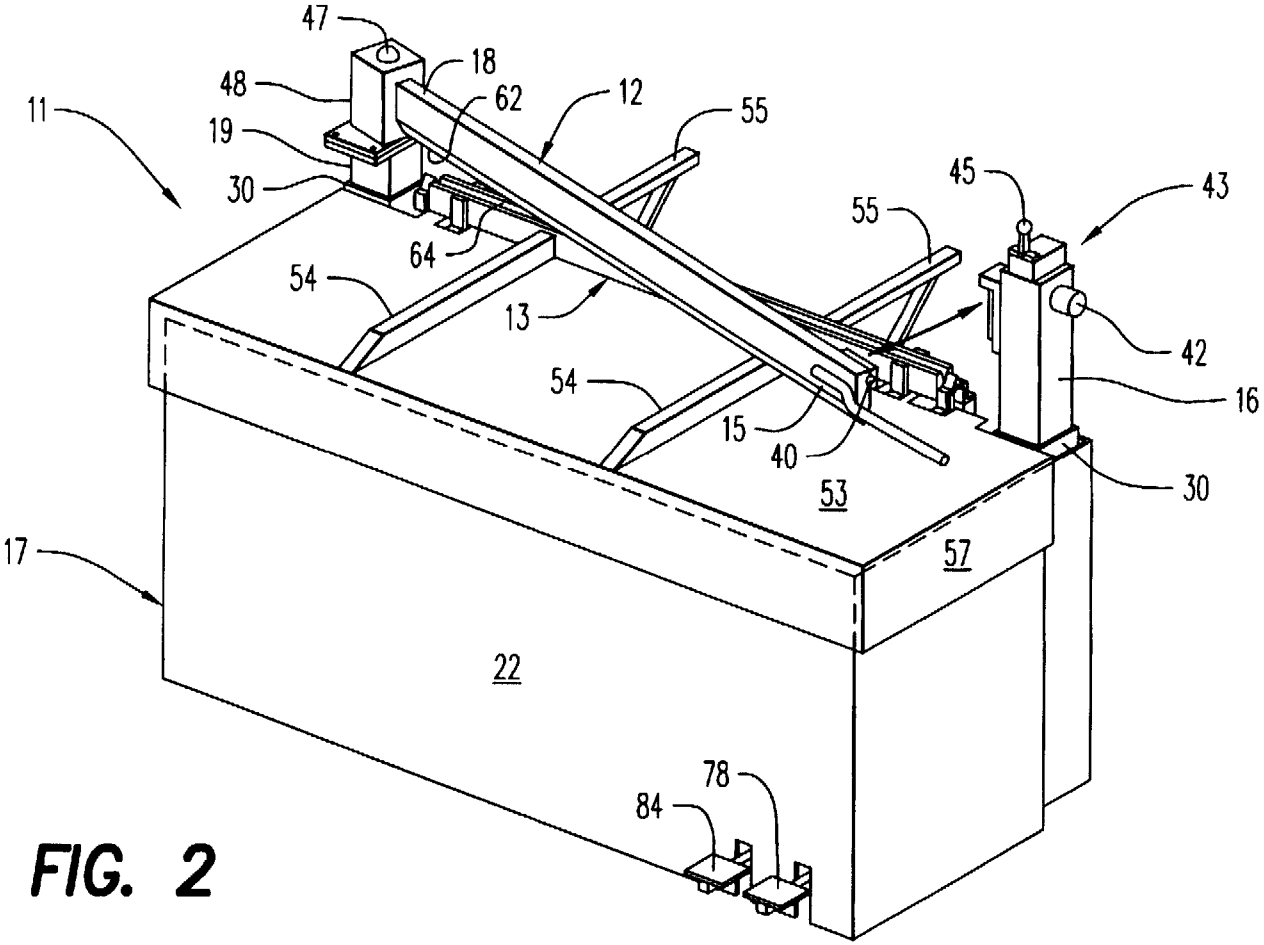
FIG. 2 is a perspective view similar to that shown in FIG. 1 but with a movable die in a different position.

After appropriate positioning of the sheet metal piece 71, the machine operator activates a foot pedal 78 (FIG. 1) to activate the air cylinders 33 and produce a reciprocating cycle of the pistons 32. During outward movement of the pistons 32, the crank arms 29 rotate the shaft 26 producing upward movement of the die 13 into an active position (FIG. 3) in which the knife edge 62 (FIG. 5*d*) is received by the groove 64. Inward movement of the pistons 32 returns the second die 13 to an inactive position shown in FIGS. 1 and 2. Movement of the die 13 into its active position produces in the sheet metal piece 71 a second 90° bend 81 parallel to the initial bend 73 as shown in FIG. 5*a*. Next, the operator moves the piece 71 into a second position with another pair of notches 83 (FIG. 1) on the opposite side edges 70 aligned with the lower die 13. Actuation of a dwell foot pedal 84 closes the dies 12, 13 and produces in the piece 71 a third 90° bend 85 parallel to the bends 73 and 81. After formation of the third bend 85, the piece 71 is an open ended tube that encloses the upper die 12 as shown in FIG. 5*b*.

After creation of the bend 85, the operator inserts the tab edge 75 of the piece 71 into the pocket edge 76 therefor as shown in FIG. 5*c*. The engaged position of the edges 75, 76 then is maintained by manually tacking the pocket edge 76 to the inserted tab edge 75. During the tacking procedure, the piece is stabilized between the dies 12, 13 by prior activation of the dwell foot pedal 84 (FIG. 1) which retains the active position of the second die 13. A subsequent activation of the foot pedal 84 then returns the die 13 to its inactive position. Next, the operator repositions the piece 71 to place an outer marginal portion 87 of the pocket edge 76 into the elongated notch 65 in the groove 64 as shown in FIG. 5*d*. Actuation of the foot pedal 78 then closes the dies 12 and 13 to collapse the pocket portion 89 of the rear edge 76 and thereby securely retain the tab edge 75 therein as shown in FIG. 53. In addition, the marginal portion 87 of the rear edge 76 is bent at 90° against a longitudinal portion of the piece 71 contiguous to the tab edge 75.

After securement of the Pittsburgh seam, the operator activates the actuator lever 45 to withdraw the pin 41 from the opening 40 and thereby detach the upper die 12 from the support member 16. The operator then grasps the handle 51 and pivots the upper die 12 on the second support member 19 as depicted by dashed lines in FIG. 4*a*. Separation of the support member 16 and the second die 12 isolates the one end 15 thereof permitting withdrawal of the completed and closed duct section 71 over the exposed end 15 of the upper die 12.

Obviously, many modifications and variations of the present invention are possible in light of the above teachings. For example, when used with a sheet metal piece not having a preformed bend 73, that bend also could be produced by an additional bending step of the type described above for creation of the bends 81 and 85. It is to be understood, therefore, that the invention can be practiced otherwise than as specifically described.

What is claimed is:

1. A closed tube forming apparatus comprising:

a base including spaced apart first and second support members;

an elongated first die having one end supported by said first support member and an opposite end supported by said second support member; said one end being detachable from said first support member so as to permit separating movement therebetween;

an elongated second die supported by said base and extending parallel to said first die;

one of said first and second dies having a transverse V-shaped cross section forming a knife edge and the other of said first and second dies defining a longitudinally extending V-shaped groove conforming substantially to said V-shaped cross section;

a drive mechanism for producing relative movement between said first and second dies into forming positions with said knife edge received by said groove; and a release mechanism operable to effect said detachment of said one end from said first support member and thereby permit said separating movement therebetween into positions substantially spaced apart.

2. An apparatus according to claim 1 wherein said one end of said first die is mounted for said separating movement away from said first support member after detachment therefrom by said release mechanism.

3. An apparatus according to claim 2 wherein said separating movement of said first die is in a direction different than said relative movement between said first and second dies.

4. An apparatus according to claim 3 wherein said relative movement between said first and second dies is in a plane defined thereby, and said separating movement is transverse to said plane.

5. An apparatus according to claim 4 wherein said opposite end of said first die is pivotally supported by said second support member, and said first die is above said second die.

6. An apparatus according to claim 5 wherein said drive mechanism comprises piston means for producing vertical upward movement of said second die relative to said first die, said base comprises a cabinet enclosing said drive mechanism and projecting in a horizontal direction from said second die, and said first die is mounted on said second support member for pivotal movement in said horizontal direction.

7. An apparatus according to claim 6 including a table attached to for movement with said second die and covering said housing.

8. An apparatus according to claim 7 including a skirt secured to said table and extending downwardly therefrom, said table and said skirt being shaped and arranged to prevent exposure of said drive mechanism during said upward movement of said second die.

9. An apparatus according to claim 8 wherein said first die forms said knife edge, said drive means produces movement of said second die into its said forming position; and including a cycle control mechanism for producing reciprocating strokes of said second die between active and inactive positions, and a dwell control mechanism for retaining said second die in said active position.

10. An apparatus according to claim 1 wherein said second die further defines an elongated notch formed longitudinally in said groove and adapted to receive an outer edge of a Pittsburgh type joint of a duct being formed by said first and second dies.

11. A method of forming a closed tube comprising the steps of:

providing an elongated first die having one end supported by a first support member and an opposite end supported by a second support member;

providing an elongated second die movable toward said first die and arranged to produce a substantially 90° bend in a piece of sheet metal material;

sequentially feeding a piece of sheet metal into different positions between said first and second dies;

activating said second die in each said position to produce a 90° bend in the piece, said bends being parallel and forming the piece into an open ended closed tube enclosing said first die;

isolating said one end of said first die from said first support member; and removing the tube from the first die by withdrawal thereof over said isolated one end of said first die.

12. A method according to claim 11 wherein said isolating step comprises separating said one end of said first die from said first support member.

13. A method according to claim 12 wherein said separating step comprises detaching said one end of said first die from said first support member.

14. A method according to claim 13 wherein said separating step further comprises pivoting said first die on said second support member.

15. A method according to claim 11 including the step of engaging edge portions of a Pittsburgh type seam previously formed in the piece.

16. A method according to claim 15 wherein said isolating step comprises separating said one end of said first die from said first support member.

17. A method according to claim 16 wherein said separating step comprises detaching said one end of said first die from said first support member.

18. A method according to claim 17 wherein said separating step further comprises pivoting said first die on said second support member.

19. A method according to claim 11 including the step of creating an initial 90° bend in the piece fed between the first and second dies, and wherein said feeding step comprises sequentially feeding the piece into two different said positions.

20. A method according to claim 11 wherein said feeding step comprises sequentially feeding the piece into three different said positions.

* * * * *